US005726369A

United States Patent [19]

Gilday

[11] Patent Number: 5,726,369

[45] Date of Patent: Mar. 10, 1998

[54] MUSICAL INSTRUMENT AND A DEVICE FOR CONNECTING ACCESSORIES THERETO

[76] Inventor: Jeffery Gilday, 772 Watersedge Dr., Ann Arbor, Mich. 48105

[21] Appl. No.: 619,017

[22] Filed: Mar. 20, 1996

[51] Int. Cl.[6] ..... G10D 3/00

[52] U.S. Cl. ..... 84/327; 84/453

[58] Field of Search ..... 84/327, 453, 291, 84/723, 725, 743

[56] References Cited

U.S. PATENT DOCUMENTS

| | | | |
|---|---|---|---|
| 3,837,255 | 9/1974 | Starns et al. | 84/317 |
| 3,901,118 | 8/1975 | Ford | 84/1.16 |
| 4,142,435 | 3/1979 | Pozar | 84/1.15 |

*Primary Examiner*—Michael L. Gellner
*Assistant Examiner*—Shih-Yung Hsieh
*Attorney, Agent, or Firm*—Barbara M. Burns

[57] ABSTRACT

A device and method for automatically controlling accessories connected with a musical instrument. A switch on a movable arm of an instrument stand indicates the presence of the instrument. The switch is normally closed activating all connected accessories unless the instrument is placed in the stand. The placement of the instrument in the stand opens the switch, turning off the power to the accessories. The entire system is set up and then locked out to prevent unauthorized use of the instrument. A battery in the instrument powers a transmitter also contained in the instrument. Thus, is eliminated the wearing of a body transmitter by the performer or a direct line connection. A charging unit is built into the device to automatically charge the battery in the instrument during the time the instrument remains in the stand. Battery replacement is eliminated. A method for improving sound from an instrument comprises encasing the magnetic field coil within a permanent solid material.

14 Claims, 3 Drawing Sheets

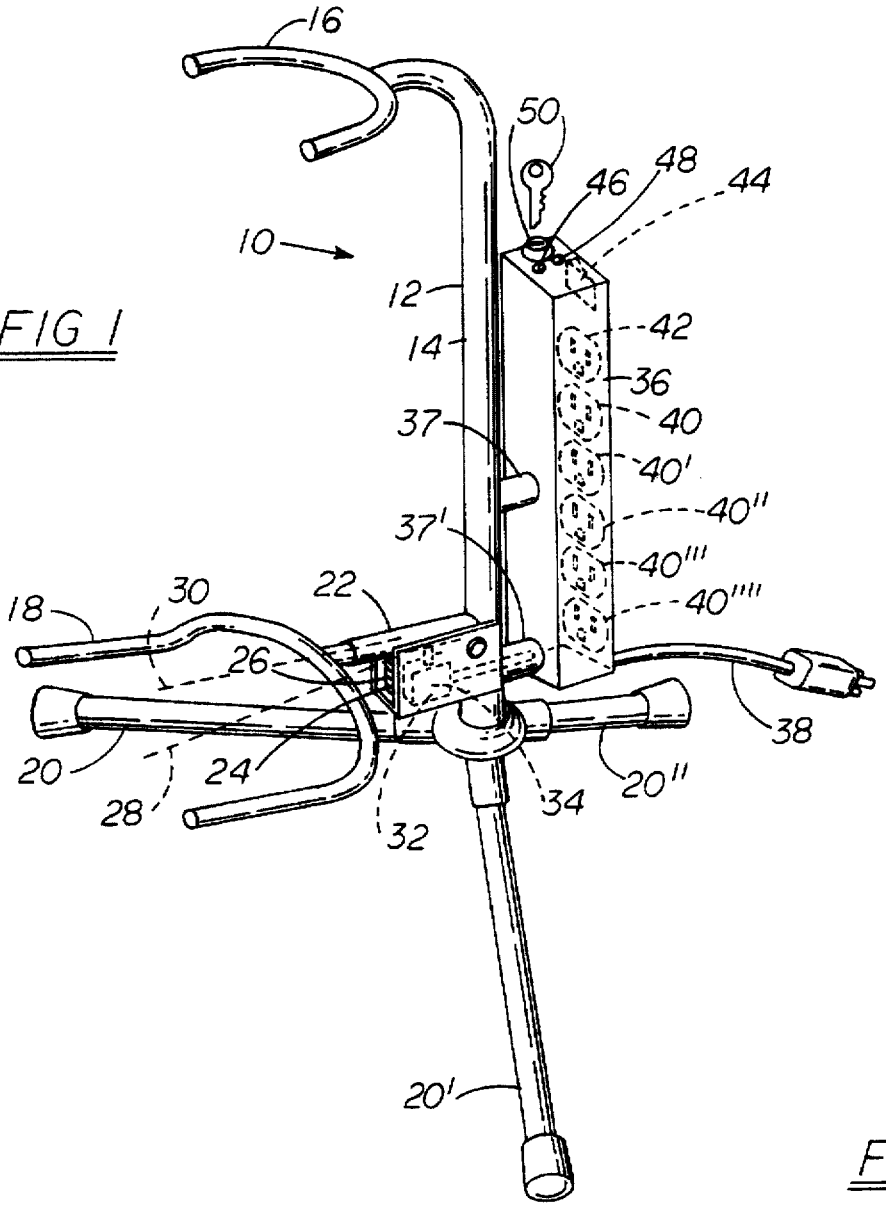
FIG 1
FIG 3
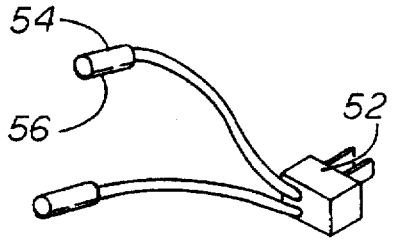

MUSICAL INSTRUMENT AND A DEVICE FOR CONNECTING ACCESSORIES THERETO

BACKGROUND OF THE INVENTION

The field of the invention pertains to musical instruments. In particular, the invention pertains to improvements to an electrical musical instrument and a device for holding the electrical musical instrument and controlling accessories connected thereto. The improvements deal with sound quality and transmission of the sound from the instrument.

In the past, during performance or practice situations, whenever an electrical musical instrument was being used, a myriad of electrical connections connected all the accessory devices such as amplifiers, microphones, lights, etc. in the musical system to the mixing panel. Even in the circumstance that the musical instrument was not itself electrified, many electric accessories were employed therewith. Each accessory device had a separate power switch necessitating each accessory to be individually switched on.

Heretofore, when a performer was ready to play, there was a time delay as all the accessory devices were switched on. Instead of wasting time, some performers set all the equipment in advance and left the equipment switched on. But leaving all the equipment on unduly wasted energy as well as giving any interloper a chance to misadjust the equipment.

Early on, the instrument was hard wired directly to the mixing panel. The use of a direct line connection limited the performer's range of motion across the stage. Moreover, the direct line connection posed a tripping hazard to the performer.

Thereafter, body worn transmitters were developed. The performer wore a transmitter to transmit the sound to the mixing panel without a direct line connection. Unfortunately, a body worn transmitter often became dislodged or covered by material, thereby obscuring transmission of a quality signal. The body worn transmitter could be wireless. Additionally, the charge level of the battery in a body worn wireless transmitter was not readily apparent. The charge level of the battery in the body worn wireless transmitter could sometimes become low or depleted thus sending a weak signal or worse, no signal at all. To be on the safe side, prior to a performance, all the batteries in body worn wireless transmitters were replaced with new batteries.

To improve the sound quality from the instrument, it was known to apply wax to the magnetic field coil of the instrument. The disadvantage is that the wax can be vibrated loose during a strenuous performance. Other disadvantages to wax were that the wax had opacity and visually occluded the components, and that the wax could melt under the high heat on stage from the stage lights. Any melting of the wax during a performance led to an undesirable change in sound quality part way through a performance.

Thus, no known device exists to control accessories associated with the instrument by the instrument itself. Nor does any known device exists to transmit from the instrument itself. Moreover, no known device exists to effectively improve the quality and transmissibility of the sound emanating from the instrument.

Attempts have been made to solve these problems, as discussed above. However, difficulties exist with the known solutions. It is to solving these problems that the instant invention is directed.

SUMMARY OF THE INVENTION

The invention is directed to improvements to a musical instrument, electric or otherwise, but is not limited thereto.

Essentially, the invention comprises an instrument stand used with an instrument that has the capability of indicating that an instrument has been positioned thereon. The indication that an instrument is positioned on the instrument stand operates a switch for controlling accessory devices.

The switch operates in response to a movable lower arm or fork that is pivotably attached to an instrument stand. The depression of the lower arm or fork by the weight of the instrument indicates that the instrument has been positioned thereon the instrument stand. The switch turns off power to accessories when the weight of the instrument depresses the movable lower arm of the stand into a low position.

Conversely, the switch turns on power to the accessories when the instrument is removed from the stand. The removal of the instrument releases the movable lower arm or fork of the stand as will discussed in greater detail hereinbelow. The switch employed herein is a normally closed switch so that when the movable lower arm or fork is weighted by the placement of the instrument, the switch is opened, cutting off power to the accessories.

When the instrument is removed from the stand, the movable lower arm or fork is unweighted and the movable lower arm or fork moves upwardly into a high position. The movement of the movable lower arm or fork operates the switch to close and complete the power circuit to the accessories through a power center or circuit bar without each individual accessory being switched on.

A rechargeable battery is contained on board the instrument. The battery supplies power to a wireless transmitter contained within the instrument. This provision of a battery powered wireless transmitter, frees the performer from the limitations of either a direct wire connection or the wearing a body worn wireless transmitter.

The on board battery and wireless transmitter allows the performer to move around the stage unconstrained. Further, the battery is capable of being recharged. Charging contacts are deployed on the lower arm or fork of the instrument stand. The charging contacts are electrically connected to a transformer placed in a single outlet of the power center that remains independently switched on at all times that the power center is on. The transformer converts the 110 volt alternating current to a low voltage direct current for charging the rechargeable battery. Moreover, the charging contacts can disposed on a device near to and touching the instrument such as an instrument case. Disposing the charging contacts within an instrument case and using an adapter perhaps from a cigarette lighter outlet facilitates charging during transit of the instrument.

The instrument has corresponding charging contacts disposed thereon. The charging contacts on the instrument connect to the battery on board the instrument. The charging contacts are arranged near the bottom of the instrument so as to not interfere with the performer while the instrument is in use. The battery in the instrument is recharged whenever the instrument is held by the instrument stand. Any questioning of the battery charge level and any need for replacement of the battery is accordingly alleviated by the rechargeable on board battery.

Another advantage according to the invention is a method for improving the sound from the instrument by encasing the magnetic field coil (commonly known as the pick up) of the instrument within a permanent solid material. Electronic current is generated in response to a magnetic flux field moving through a coil of wire. The coil of wire is made from fine gage wire wrapped in many coils. The vibration of the strings of the instrument acts on the flux field of the magnet in proximity to the coil. The coil and/or the magnet can vibrate loose but encasement in a solid material secures these electronic components.

The sound waves or magnetic flux fields that are generated by the electronic componentry are more readily transferred through the solid material before being sent by the transmitter. The permanent solid material can be transparent for ease in viewing the electronic components. A thermosetting plastic such as epoxy casting resin is desirable to be selected for the material so as not to be heat degradable.

It is envisioned that the invention is useful for use with an electric guitar. The invention can also have use for other instruments, such as a saxophone, keyboard, etc.

The invention can advantageously employed as a totally new installation or the invention would be useful as a retrofit to an existing electrical instrument. While directed to instruments as discussed above, the invention herein disclosed is not limited thereto but has other uses.

For a more complete understanding of the present invention, reference is made to the following detailed description when read with in conjunction with the accompanying drawings wherein like reference characters refer to like elements throughout the several views, in which:

BRIEF DESCRIPTION OF THE DRAWINGS

FIG. 1 illustrates an environmental view of the device according to the invention;

FIG. 3 illustrates a perspective view of a transformer and connections for recharging a rechargeable battery according to the invention;

DESCRIPTION OF THE PREFERRED EMBODIMENT

Figure 2:
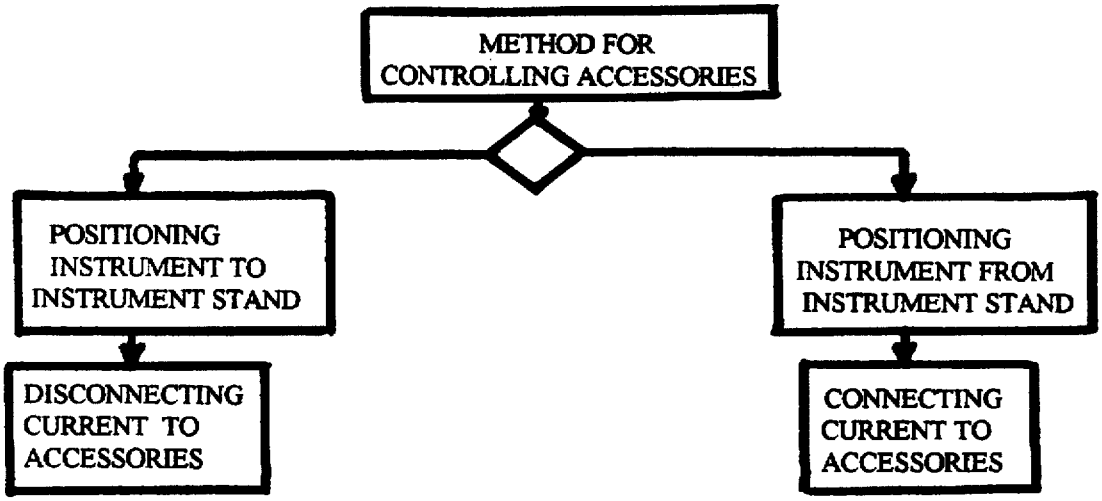
FIG. 2 illustrates the steps for the method of controlling accessories in conjunction with an instrument.

In FIG. 1, a device generally denoted as 10 is thereshown. The device 10 comprises an instrument stand 12 shown as a vertical post 14 having an upper arm 16, a movable lower arm 18 and support legs 20, 20' 20" thereunder.

Means for indicating 22 the presence of an instrument comprise the movable lower arm 18 and means for resiliently biasing 24 the movable lower arm 18. The means for resiliently biasing 24 is hereshown as a spring 26, but other means could be advantageously employed herein. It is to be understood that the movable lower arm 18 is positionable between a low position 28 which is weighted by the weight of an instrument and a high position 30 as hereshown wherein the movable lower arm 18 is unweighted because the instrument has been removed. The weight of the instrument in the instrument stand pushes the movable lower arm downwardly overcoming the tension of spring 26.

Means for controlling 32 an electric current to accessories is hereshown as a switch 34. The switch 34 opens and closes in response to the position of the movable lower arm 18. The switch 34 is a normally open switch and is open when the movable lower arm 18 is in the high position 30. The switch 34 is connected to a power center 36 or breaker bar into which the accessories have been connected. The power center 36 is connected to a source of electrical current in order to power the system of connected accessories.

The power center 36 controls the electrical current or power into the system for all the connected accessories. The power center 36 is mounted to the vertical post 14 at two points 37, 37' of the instrument stand 12. Storage of the cord 38 associated with the power center 36 is effectuated by wrapping the cord 38 around the two points 37, 37' and stowing the cord 38 between the power center 36 and the vertical post 14. The storage of the cord 38 in this manner clears the performance area yet the cord 38 is readily accessible if needed.

The power center 36 has multiple outlets 40, 40', 40", 40'", 40"", and 42 (shown with hidden lines) for connecting various accessories to the power center 36. A main switch 44 on the power center 36 when operated turns off power to all the outlets 40, 40', 40", 40'", 40"", and 42 on the power center 36. Indicator lights 46, 48 on the power center 36 show that the power center 36 is turned on and that current is flowing through the circuit.

Once the instrument and accessories have been set up to the satisfaction of the performer, the entire set up can be locked out by the use of a selectable lock 50 on the power center 36. The selectable lock 50 allows the entire system to be set and then to turn off the current to the entire system to prevent unauthorized meddling with the instruments.

When the main switch 44 on the power center 36 is in the on position, the switch 34 on the instrument stand 12 controls power to all but one 42 of the outlets and hence all the accessories.

FIG. 2 shows the steps in the method for controlling accessories in conjunction with an instrument. The presence and absence of the instrument in the instrument stand operates a switch to power the accessories. Positioning the instrument to and from the unit or the instrument stand connects and disconnects electric current to the accessories.

Figure 4:
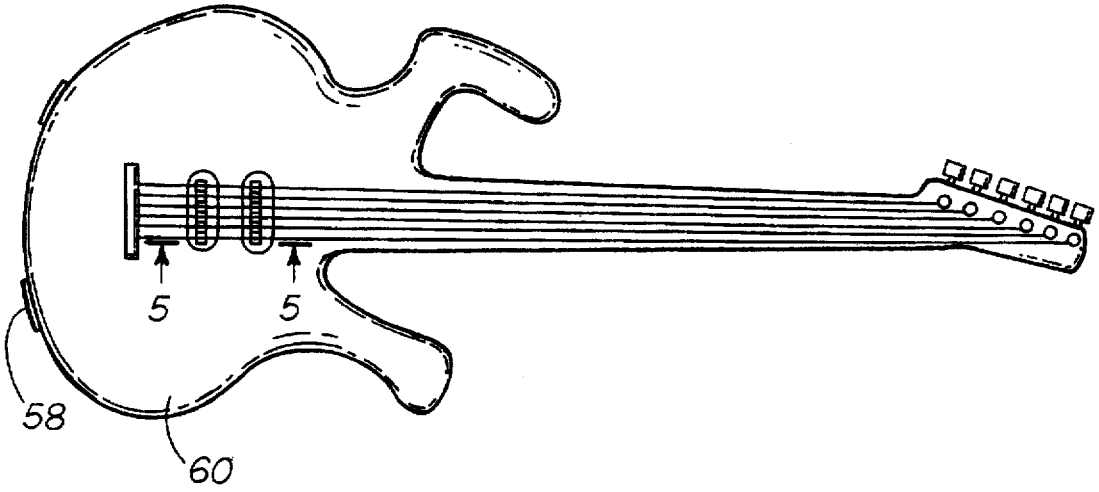
FIG. 4 illustrates a top view of an instrument having charging contacts.

The one outlet 42 that is not controlled by the switch 34 on the instrument stand 12 remains on at all times the main switch 44 on the power center 36 is in the on position. The one outlet 42 has a transformer 52 emplaced thereto. The transformer 52 is depicted in FIG. 3 and is a DC low voltage transformer and is connected with means for connecting 54 hereshown as tubular copper contacts 56 disposed on the movable lower arm 18 and corresponding contacts 58 on the instrument 60 (FIG. 4).

Figure 5:
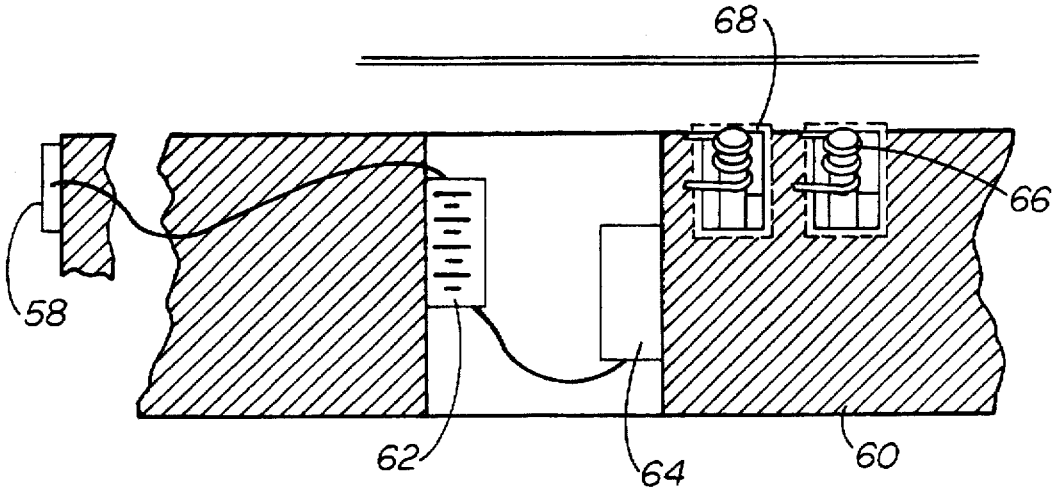
FIG. 5 illustrates a partial sectional view of an instrument showing the on board wireless transmitter, the on board rechargeable battery and the encasement of the magnetic field coils.

The tubular copper contacts engage 56 with contacts 58 on the instrument 60 and electrically connect to a rechargeable battery 62 contained on board or interiorly to the instrument (FIG. 5). The rechargeable battery 62 powers a wireless transmitter 64 also on board the instrument (FIG. 5). Accordingly, the rechargeable battery 62 is automatically recharged at all times when the instrument is positioned in the instrument stand 12 of this invention and the system is connected to a source of electrical current.

Figure 6:
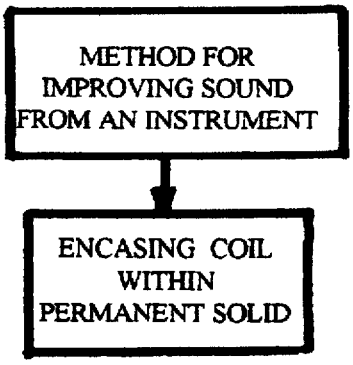
FIG. 6 illustrates the steps for the method of improving the sound from the instrument.

The electronic componentry of the instrument is depicted in the instrument 60. The electronic componentry comprises a magnetic field coil 66, and other circuitry. The encasement of the magnetic field coil by a solid permanent material 68 is indicated with phantom lines. A method for improving sound from the instrument comprises the step of encasing the electronic componentry in a solid permanent material (FIG. 6).

I claim:

1. A device for automatically controlling at least one accessory in conjunction with an instrument, the device comprising a unit for positioning the instrument, the unit having means for indicating the presence and the absence of the instrument, and means for controlling an electric current to the at least one accessory based on the means for indicating the presence and absence of the instrument.

2. The device according to claim 1 wherein the means for indicating the presence and absence of the instrument comprises a movable arm.

3. The device according to claim 2 further comprising means for resiliently biasing the movable arm.

4. The device according to claim 3 wherein the means for resiliently biasing the movable arm comprises an adjustable spring.

5. The device according to claim 1 wherein the means for controlling an electric current comprises a switch.

6. The device according to claim 1 further comprising a power center connectable with the at least one accessory.

7. The device according to claim 5 wherein the power center further comprises a selectable lock to control flow of current through the power center.

8. A device for controlling at least one accessory, the device having means for indicating an instrument is positioned to the device, the device comprising a main member, a holder resiliently attached to the main member, means for resiliently biasing the holder between a first position having an instrument absent and a second position having an instrument present, means for indicating the first position and the second position, and means for connecting power to the at least one accessory, the means for connecting power controlled by the means for indicating the first and the second position.

9. The device according to claim 8 wherein the means for connecting power to the at least one accessory connects the power when the means for indicating indicates the first position.

10. A method for using the device according to claim 1 to control at least one accessory comprising the following step positioning an instrument to and from the unit, thereby operating the means for controlling an electric current to connect and disconnect electric current to the at least one accessory.

11. The device according to claim 1 wherein the instrument has a battery and further comprising means for recharging the battery of the instrument when the instrument is positioned in the unit.

12. The device according to claim 11 wherein the battery is contained within the instrument.

13. The device according to claim 1 wherein a transmitter is contained in the instrument.

14. The device according to claim 11 wherein the battery powers a transmitter.

* * * * *